US008742662B2

(12) United States Patent
Reynolds et al.

(10) Patent No.: US 8,742,662 B2
(45) Date of Patent: Jun. 3, 2014

(54) MAGNETRON

(75) Inventors: Alan Reynolds, Chelmsford (GB); Robert Charles Wilson, Maldon (GB); Kesar Saleem, Ilford (GB); Ian Milsom, Great Waltham (GB)

(73) Assignee: E2V Technologies (UK) Limited, Chelmsford (GB)

( * ) Notice: Subject to any disclaimer, the term of this patent is extended or adjusted under 35 U.S.C. 154(b) by 495 days.

(21) Appl. No.: 13/076,977

(22) Filed: Mar. 31, 2011

(65) Prior Publication Data

US 2011/0241542 A1 Oct. 6, 2011

(30) Foreign Application Priority Data

Mar. 31, 2010 (GB) ..... 1005450.0

(51) Int. Cl.
*H01J 25/54* (2006.01)

(52) U.S. Cl.
USPC ..... 315/39.67

(58) Field of Classification Search
USPC ..... 315/39, 39.63, 39.67; 313/331, 313/337–339, 346 R
See application file for complete search history.

(56) References Cited

U.S. PATENT DOCUMENTS

| | | | | |
|---|---|---|---|---|
| 2,437,880 | A | 3/1948 | Kusch | |
| 6,756,735 | B2 * | 6/2004 | Lee et al. | 315/39.51 |
| 2009/0236991 | A1 | 9/2009 | Wilson | |

FOREIGN PATENT DOCUMENTS

| | | |
|---|---|---|
| CN | 201374306 Y | 12/2009 |

OTHER PUBLICATIONS

Great Britain Search Report of Application No. GB1005450.0 dated Aug. 3, 2010.
Great Britain Search Report of Application No. GB1104879.0 filed Jul. 21, 2011.

* cited by examiner

*Primary Examiner* — Jimmy Vu
(74) *Attorney, Agent, or Firm* — Venable LLP; Robert Kinberg

(57) ABSTRACT

A magnetron includes a cathode and a vacuum envelope in which the cathode extends. The vacuum envelope includes a portion extending radially relative to the axis of the cathode. A pair of electrically conducting support arms for supporting the cathode are in electrical connection with cathode supply terminals. The support arms have free ends connected to the cathode by leads. A wall extends across an area of the radially-extending portion. The wall is positioned along the radially-extending portion nearer to an end of the radially-extending portion that is adjacent to the cathode than to an end that is remote from the cathode and the support arms are mounted in the wall.

12 Claims, 3 Drawing Sheets

MAGNETRON

CROSS-REFERENCE TO RELATED APPLICATIONS

Priority is claimed with respect to Great Britain Application No. GB 1005450.0 filed on Mar. 31, 2010, the disclosure of which is incorporated herein by reference in its entirety.

BACKGROUND

This invention relates to magnetrons.

Magnetrons are used in linear accelerator systems (linacs) to generate X-rays, and one use of such linacs is to generate X-rays for the treatment of tumours in radiotherapy. In an attempt to deliver the optimum dose of radiation to a tumour, linacs are being mounted on gantries which rotate around the patient, sometimes at high speed, while the X-ray dose is being delivered. This causes a problem, in that to achieve optimum performance the cathode must be held in a precise position in a hollow cylindrical anode with a high voltage between the anode and cathode. The cathode may be supported on a pair of electrically conducting arms which are anchored into the vacuum envelope at their ends.

Thus, referring to FIGS. 1 and 1*a*, which are, respectively, a schematic fragmentary axial cross-section through a radially-extending part of a known magnetron, and a fragmentary end view of part of the anode interior, the cathode 1 is supported in a hollow cylindrical anode 2 by means of tungsten support arms 3, 4. The radially-extending portion of the vacuum envelope, generally termed a sidearm, and indicated generally by the reference numeral 5, is ceramic and carries on its exterior the cathode terminals 6, 7 across which a DC heater voltage for the cathode is applied, superimposed on the high negative voltage required for operation of the magnetron. The main body 8 of the magnetron is made of metal, and has channels 9, 10 to accommodate the support arms 3, 4. The radially-extending portion includes a metal ring 11, which is welded to the main body 8, and brazed to ceramic sleeve 12, which is metallised on its lower circular edge. The radially-extending portion is closed by a wall 13 which is sealed to the cylindrical sleeve 12. The support arms 3, 4 make electrical connection with these terminals 6, 7, because their ends are secured into sockets 14, 15 which are supported in the wall 13 in a vacuum-tight manner and connect through to the terminals 6, 7 outside.

At the free ends, the cathode support arms are connected to opposite ends of the cathode 1 by means of leads 29, 30. The cathode support arms 3, 4 terminate short of the cylindrical anode space 2, to allow room for the cathode to be inserted in an axial direction during manufacture (see FIG. 1*a*), and the leads are only connected when the cathode has been assembled into the anode space. The lead 30 at one end may be v-shaped, the apex being connected to the cathode support arm 4, and the ends of the limbs being connected to the cathode. The lead 29 at the other end may be a conductor bent into parallel strands and connected to a heater lead extending from the other end of the cathode through an insulating collar (not shown, but illustrated in our US patent publication no. 2009/0236991, incorporated herein by reference).

It is believed that the support arms 3, 4 are prone to pick up mechanical vibrations, which can impair the correct functioning of the magnetron.

SUMMARY

In one embodiment of the invention there is provided a magnetron, comprising: a cathode having an axis; a vacuum envelope in which the cathode extends, the vacuum envelope including a portion extending radially relative to the axis of the cathode; cathode supply terminals; a pair of electrically conducting support arms for supporting the cathode and in electrical connection with the cathode supply terminals, the support arms having free ends connected to the cathode by leads; and a wall extending across an area of the radially-extending portion, wherein the wall is positioned along the radially-extending portion nearer to an end of the radially-extending portion that is adjacent to the cathode than to an end that is remote from the cathode, and the support arms are mounted in the wall.

Reducing the free length of the support arms by mounting them in a wall positioned intermediate the ends of the radially-extending portion in this way permits undesirable frequencies of vibration to be reduced or eliminated.

Each support arm may be in two parts secured together, one part, which could be made of tungsten, or molybdenum, or copper, or nickel, or alloys thereof, being mounted in the wall and having a greater diameter than the other part, which could be made of tungsten, or molybdenum, or alloys thereof, which is connected to the cathode. If desired, the support arms may be in more than two parts.

The wall may be formed integrally with the part of the radially-extending portion that is remote from the cathode, and may be connected to the part adjacent to the cathode by sealing material, in order to allow access to the wall for application of metallisation. The parts may be made of ceramic material.

The wall may be positioned along the radially-extending portion less than one third, or less than one quarter, of the length from the end adjacent the cathode to the end remote from the cathode.

The support arms preferably terminate outside the projection of the cylindrical anode profile, and leads, which may be of nickel wire, are welded or brazed to make the connection between the cathode and the cathode support arms during assembly of the magnetron.

BRIEF DESCRIPTION OF THE DRAWINGS

One way of carrying out the invention will now be described in detail, by way of example, with reference to the accompanying drawings, in which.

Like reference numerals have been given to like parts throughout all the Figures.

DETAILED DESCRIPTION

Figure 1:
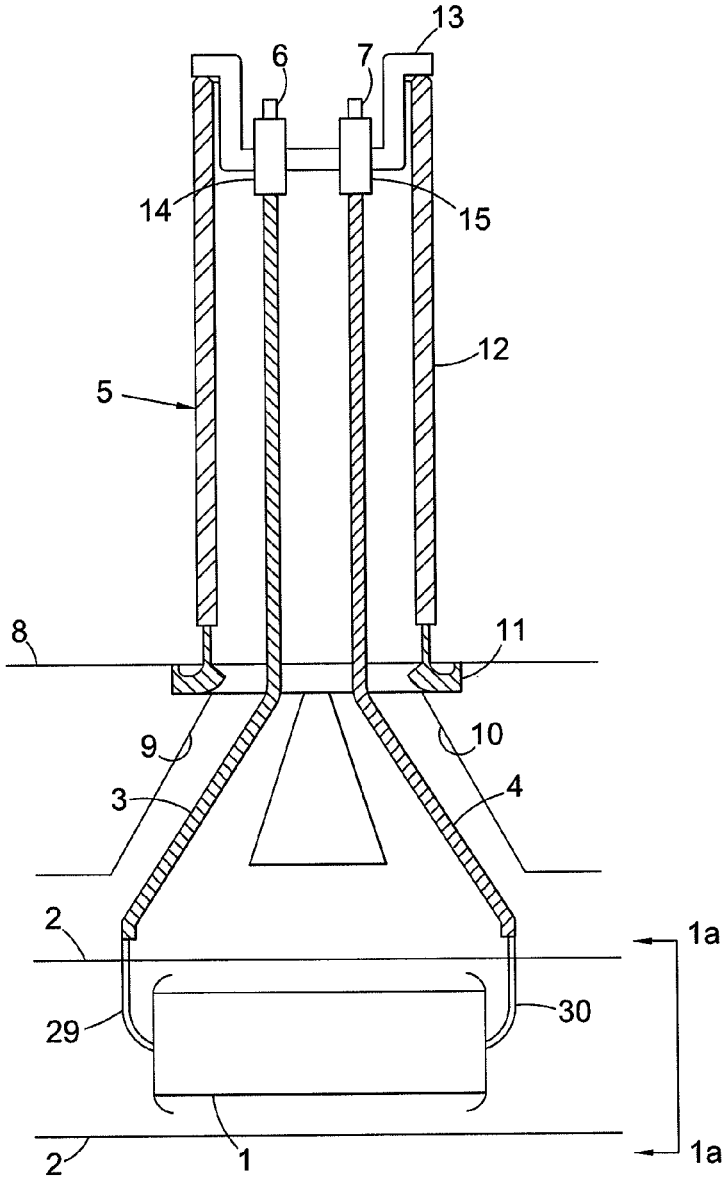
PRIOR ART Fig. 1
FIG. 1 is a schematic fragmentary axial cross-section through a radially-extending part of a known magnetron.
Figure 1A:
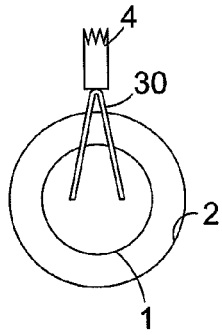
FIG. 1*a* is a fragmentary end view of the magnetron of FIG. 1 looking along the lines 1*a*-1*a* in FIG. 1.

The magnetron of the invention differs from the known magnetron of FIG. 1 in the construction of the radially-extending sidearm portion 5 of the vacuum envelope, and specifically in the mounting of the cathode support arms.

Figure 2:
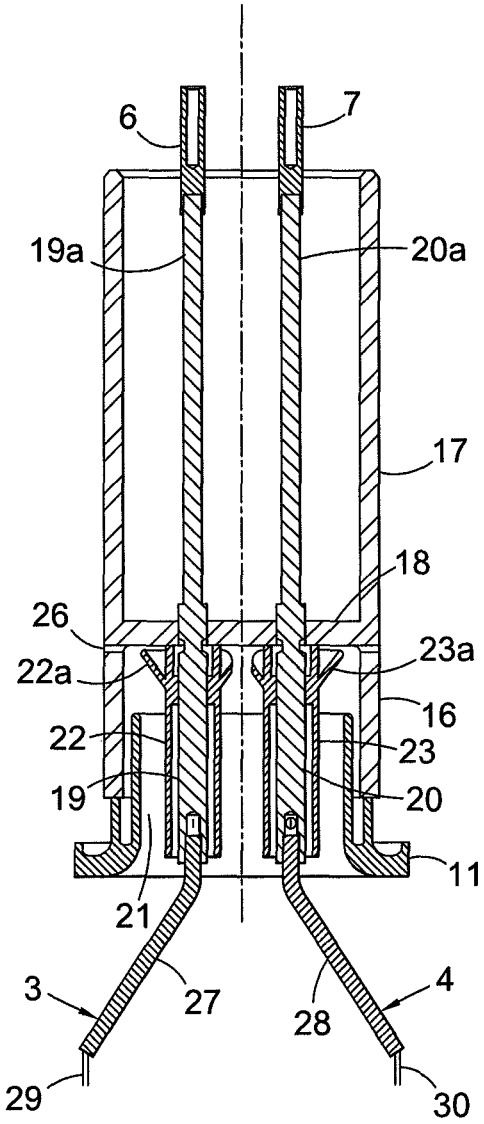
FIG. 2 is an axial cross-section of a radially-extending part of a magnetron according to the invention.
Figure 3:
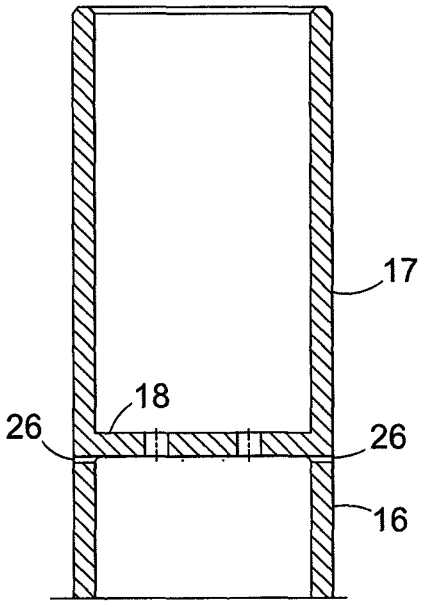
FIG. 3 is an axial cross-section through the ceramic component of the radially-extending part shown in FIG. 2.

Referring to FIG. 2, the radially-extending portion includes two tubular ceramic members, 16, 17, the latter having a closed lower end wall 18. The tubular ceramic member 16 is metallised on its lower curved edge, and is brazed to a metal ring 11, which is also welded to the main body of the magnetron, which is as shown in FIG. 1 and therefore not illustrated in FIG. 2. The cathode and cathode leads 29, 30 are also as shown in FIG. 1.

In contrast to the known magnetron of FIG. 1, the free length of the cathode support arms indicated generally by the reference numerals 3, 4, is much shorter, and the arms are mounted in a vacuum-tight manner in openings in the lower end wall 18, which is positioned nearer to the cathode end of the sidearm extension than to the other end of the sidearm extension. Also, each support arm 3, 4 is in two parts secured together, one part 19, 20 being anchored to the wall 18 and having a greater diameter than the other part 27, 28 which is connected to the cathode leads 29, 30.

The parts 19, 20 of the support arms have integral extensions 19*a*, 20*a*, and the cathode supply terminals 6, 7 are secured to the ends of the extensions. The terminals and the integral extensions are protected by the tubular member 17, which also holds off the high voltage between the anode body and the terminals 6, 7. If desired, the empty space within the tubular member 17 could be filled with rubber material in order to prevent corona discharge taking place within this space.

RF chokes are provided to prevent the leakage of RF through the radially-extending portion. Thus, the metal ring 11 has a quarter-wavelength choke 21, to prevent leakage of RF around the periphery of the opening into the radially-extending portion, and hollow sleeves 22, 23, also quarter-wavelength in length, surround the portions 19, 20 of the cathode support arms, to prevent leakage of RF along the cathode support arms 3, 4. The RF chokes 21, 22, 23 overlap each other. The RF chokes 22, 23 are provided with flared regions 22*a*, 23*a*.

Figure 4:
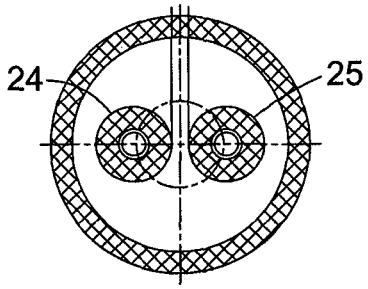
FIG. 4 is a bottom end view of the ceramic component shown in FIG. 3.

In order to maintain the integrity of the vacuum seal at the wall 18, the portions 19, 20 of the cathode support arms are brazed to narrower diameter regions of the hollow sleeves 22, 23, which are in turn brazed at their upper ends to the underside of the wall 18, the mating surfaces being metallised. In addition, the flared regions 22*a*, 23*a* are designed to overlap the metallised rings (24, 25—FIG. 4) in order to reduce the electric field strength in the region of the metallising when the conducting members 19 and 20 are pulsed at high negative voltage. The flares 22*a* and 23*a* are sliced off in the region between the two components so that they do not cause short circuit.

Such a metallising operation could be awkward to perform in the restricted space beneath the wall 18. For this reason, the tubular ceramic member 17 may be joined to the wall either during or after the metallising operations have been carried out. A layer of powdered glass 26 may be used to seal the parts together in a vacuum tight manner.

The wall 18 is positioned at least half-way along the length of the sidearm from the upper end to the lower end as seen in FIG. 2, in order to reduce the free length of the cathode support arms.

The free length of the arms 3 and 4 are much shorter than in the known magnetron of FIG. 1, and resonate at different frequencies to that at which the cathode support arms resonate in the known magnetron. It is believed that the resonance is increased in frequency, and while the support arm has been found to resonate at around 50 Hz in known magnetron, the resonance has been found to move to over 100 Hz in the magnetron according to the invention.

Various factors affect the resonance frequency of the cathode support arms. Thus, the resonance frequency depends on the stiffness of the arms, and it will be noted that the diameter of the regions 19, 20 of the support arms is greater than that of the regions 27, 28 that are connected to the cathode. In addition, the choice of larger cross section materials for the regions 19, 20 also has the benefit of increasing the heat loss through conduction from the cathode and its adjoining components. This may be advantageous if the magnetron is operated close to its upper limit for mean output power.

Suitable materials for the parts 27, 28 of the support arms are tungsten, molybdenum or other high temperature melting point metals or alloys. Suitable materials for the parts 19, 20 include tungsten, molybdenum and their alloys, copper, nickel and other alloys of nickel.

Of course, variations may be made to the embodiment described without departing from the scope of the invention. Thus, for example, the wall 18 could form the base of a very deep cup secured to the upper end of sleeve 17, that is, similar to the wall 13 of the prior art construction shown in FIG. 1, but with a depth such that the wall 18 is in the same position along the length of the sidearm. Alternatively, in the illustrated construction of FIG. 2, the tubular member 16 could be integral with the tubular member and wall 18. The tubular member 17 could be shorter in length than shown.

The invention is especially suitable for magnetrons with peak output powers from 2 MW. A typical range of operating frequencies is from 2850 MHz to 3010 MHz, the design being especially suitable for 2993 MHz to 3002 MHz.

It will be understood that the above description of the present invention is susceptible to various modifications, changes and adaptations, and the same are intended to be comprehended within the meaning and range of equivalents of the appended claims.

The invention claimed is:

1. A magnetron, comprising:

a cathode having an axis, a vacuum envelope in which the cathode extends, the vacuum envelope including a portion extending radially relative to the axis of the cathode;

cathode supply terminals;

a pair of electrically conducting support arms for supporting the cathode and in electrical connection with the cathode supply terminals, the support arms having free ends connected to the cathode by leads; and a wall extending across an area of the radially-extending portion, wherein the wall is positioned along the radially-extending portion nearer to an end of the radially-extending portion that is adjacent to the cathode than to an end that is remote from the cathode, and the support arms are mounted in the wall.

2. The magnetron as claimed in claim 1, wherein each support arm has two parts secured together, one part being mounted in the wall and having a greater diameter than the other part which is connected to the cathode lead.

3. The magnetron as claimed in claim 2, wherein the parts mounted in the wall comprise one of tungsten, molybdenum, copper, nickel, or alloys thereof.

4. The magnetron as claimed in claim 2, wherein the parts connected to the cathode leads comprise one of tungsten, molybdenum, or alloys thereof.

5. The magnetron as claimed in claim 1, wherein the wall is formed integrally with the part of the radially-extending portion that is remote from the cathode.

6. The magnetron as claimed in claim 5, wherein the part of the radially-extending portion that is adjacent to the cathode is connected to the part remote from the cathode by sealing material.

7. The magnetron as claimed in claim 5, wherein the wall has openings that receive the support arms, and a vacuum-tight seal is created by brazing to metallisation applied to the wall.

8. The magnetron as claimed in claim 7, further including sleeves surrounding the support arms to reduce the electric field strength in the vicinity of the metallisation.

9. The magnetron as claimed in claim 8, wherein the sleeves surrounding the support arms include flared regions.

10. The magnetron as claimed in claim 8, wherein the sleeves surrounding the support arms comprise quarter wavelength RF chokes.

11. The magnetron as claimed in claim 1, wherein the radially-extending portion of the vacuum envelope comprises ceramic material.

12. The magnetron as claimed in claim 1, further comprising an anode having a profile with an interior, wherein the support arms terminate outside the profile of the interior of the anode.

* * * * *